US008261526B2

(12) United States Patent
Grassi et al.

(10) Patent No.: US 8,261,526 B2
(45) Date of Patent: Sep. 11, 2012

(54) TEXTURING-INTERLACING MACHINE WITH DOUBLE OVEN

(75) Inventors: Nerino Grassi, Mantova (IT); Ezio Santino Fanti, Como (IT)

(73) Assignee: SSM Giudici S.R.L., Galbiate (LC) (IT)

( * ) Notice: Subject to any disclaimer, the term of this patent is extended or adjusted under 35 U.S.C. 154(b) by 216 days.

(21) Appl. No.: 12/677,201

(22) PCT Filed: Aug. 29, 2008

(86) PCT No.: PCT/IT2008/000564

§ 371 (c)(1),
(2), (4) Date: Jun. 21, 2010

(87) PCT Pub. No.: WO2009/040850

PCT Pub. Date: Apr. 2, 2009

(65) Prior Publication Data

US 2010/0275569 A1 Nov. 4, 2010

(30) Foreign Application Priority Data

Sep. 10, 2007 (IT) ..... FI2007A0202

(51) Int. Cl.
*D02G 3/02* (2006.01)

(52) U.S. Cl. ..... 57/287; 57/332

(58) Field of Classification Search ..... 57/284, 57/287, 288, 289, 290, 332, 351
See application file for complete search history.

(56) References Cited

U.S. PATENT DOCUMENTS

| | | | | |
|---|---|---|---|---|
| 4,218,869 | A * | 8/1980 | Newton | 57/245 |
| 4,219,997 | A * | 9/1980 | Hatcher | 57/245 |
| 4,452,160 | A * | 6/1984 | Tajiri et al. | 112/410 |
| 5,148,666 | A * | 9/1992 | Bauer et al. | 57/290 |
| 5,644,908 | A * | 7/1997 | Schippers et al. | 57/290 |
| 6,038,847 | A * | 3/2000 | Jen | 57/289 |
| 6,041,587 | A | 3/2000 | Gabalda et al. | |
| 6,399,194 | B1 * | 6/2002 | Kunisada et al. | 428/357 |
| 6,477,828 | B1 * | 11/2002 | Nolle | 57/332 |
| 6,487,842 | B2 * | 12/2002 | Tanae et al. | 57/284 |
| 6,536,199 | B2 | 3/2003 | Wortmann et al. | |
| 6,705,071 | B2 * | 3/2004 | Kataoka | 57/284 |
| 6,722,117 | B2 * | 4/2004 | Belcher et al. | 57/205 |
| 2001/0042365 | A1 * | 11/2001 | Paweletz et al. | 57/264 |
| 2002/0139104 | A1 * | 10/2002 | Kataoka | 57/284 |
| 2005/0055998 | A1 * | 3/2005 | Pyra | 57/284 |

(Continued)

FOREIGN PATENT DOCUMENTS

| | | |
|---|---|---|
| EP | 0 571 975 A1 | 12/1993 |
| EP | 0 882 146 B1 | 12/1998 |

(Continued)

*Primary Examiner* — Shaun R Hurley
(74) *Attorney, Agent, or Firm* — McGlew and Tuttle, P.C.

(57) ABSTRACT

The texturing and interlacing machine for processing synthetic yarns comprises: at least one supporting and unwinding member for at least one bobbin (B1) of untreated yarn to be textured; at least one supporting and unwinding member (31) for a bobbin (B3) of elastomer; a feed path, for at least one yarn (F1) to be textured; along the feed path for the yarn to be textured, in sequence along the direction of feed of the yarn to be textured: a stretching roller (5), a first oven (7), a cooling area (9), a yarn twisting unit (11), a master roller (13), a second oven (15), a stabilizing roller (21), an interlacing device (23) and an overfeed roller (25).

23 Claims, 2 Drawing Sheets

U.S. PATENT DOCUMENTS

2006/0042220 A1 * 3/2006 Maccabruni et al. ..... 57/264

FOREIGN PATENT DOCUMENTS

| | | | |
|---|---|---|---|
| EP | 0 939 318 | A1 | 9/1999 |
| EP | 0 994 205 | A2 | 4/2000 |
| EP | 1 598 457 | | 5/2005 |
| EP | 1 630 268 | B1 | 3/2006 |
| IT | WO 03/042437 | | 5/2003 |
| WO | WO 03/014445 | A2 | 2/2003 |
| WO | WO 2005/064053 | | 7/2005 |

* cited by examiner

TEXTURING-INTERLACING MACHINE WITH DOUBLE OVEN

TECHNICAL FIELD

The present invention relates to a machine for processing yarns. More in particular, the present invention relates to a machine for texturing and interlacing yarns, for example multifilament synthetic yarns, in particular POYs ("pre oriented yarns") and elastomers.

STATE OF THE ART

Treatment of synthetic yarns, in particular multifilament synthetic yarns, by subjecting them to a texturing treatment to obtain particular effects of softness and volume has been known for some time. Typically, this process provides for subjecting the yarn, such as polyester, Nylon®, polypropylene or the like, to a stretching and to a false twisting operation, in a section along which the yarn is subjected to a heating and to a subsequent cooling operation. The effect of this operation is to introduce, in the single filaments forming the yarn, a deformation that causes crimping thereof and consequently an overall increase in the volume and softness of the yarn.

Machines for performing texturing and false twisting are described for example in EP-A-1,630,268, U.S. Pat. No. 6,041,587, EP-B-0,882,146. In the last one in particular, there is provided a second heat treatment of the yarn after it has been subjected to a first texturing step. It is also known (see again EP-A-0,882,146) to feed two yarns, in particular two textured POYs, through an interlacing device positioned upstream of the second oven which thus performs a second heat treatment on a yarn formed by coupling two previously textured single yarns.

EP-A-1,598,457 describes a texturing and interlacing machine, wherein a synthetic yarn, for example a POY, is fed through a heat treatment oven, a cooling area, a false twisting device, a stretching roller and an interlacing device. The elastomer yarn coming directly from a bobbin is also fed to this last device. In the interlacing device, the elastomer is covered by the filaments of textured yarn. At the outlet of the interlacing jet, the composite yarn obtained is drawn by a roller and wound in a spool.

SUMMARY OF THE INVENTION

According to one aspect, an object of the invention is to provide a machine that is particularly versatile and allows different processes to be performed on yarns of the aforesaid type.

In substance, in one embodiment the texturing-interlacing machine according to the invention comprises, in combination:

- at least one supporting and unwinding member for an untreated yarn to be textured;
- at least one supporting and unwinding member for a bobbin of elastomer;
- a feed path, for at least one yarn to be textured;
- along said path for at least one yarn to be textured, in sequence along the direction of feed of said at least one yarn to be textured: a stretching roller, a first oven, a cooling area, a yarn twisting unit, a master roller, a second oven, a stabilizing roller, an interlacing device and an overfeed roller.

With a configuration of this type, the machine presents high flexibility and can perform a plurality of processes on yarns in various combinations.

According to an advantageous embodiment, the stretching roller, the master roller, the stabilizing roller and the overfeed roller are controlled by motors configured to adjust the speeds of said rollers separately from one another. For example, there can be provided separate motors for each of said rollers. Preferably, the twisting unit will also have a separate motor, or if necessary a plurality of separate motors, one for each spindle or for a group of spindles.

Preferably, the supporting and unwinding member for the untreated yarn to be textured, for example a creel, is structured to simultaneously support and unwind four bobbins of untreated yarn to be textured.

In this way a machine with four individual positions is obtained, i.e. a machine in which four yarns to be textured can be treated in parallel along a common path where each motorized member can be controlled and regulated separately from the others.

Further advantageous features and embodiments of the machine according to the invention will be described in what follows with reference to examples of embodiment and are specified in the appended claims.

BRIEF DESCRIPTION OF THE DRAWINGS

The invention will be better understood by following the description and accompanying drawing, which shows practical non-limiting embodiments of the invention. More in particular, in the drawing: la

DETAILED DESCRIPTION OF EMBODIMENTS OF THE INVENTION

Figure 1:
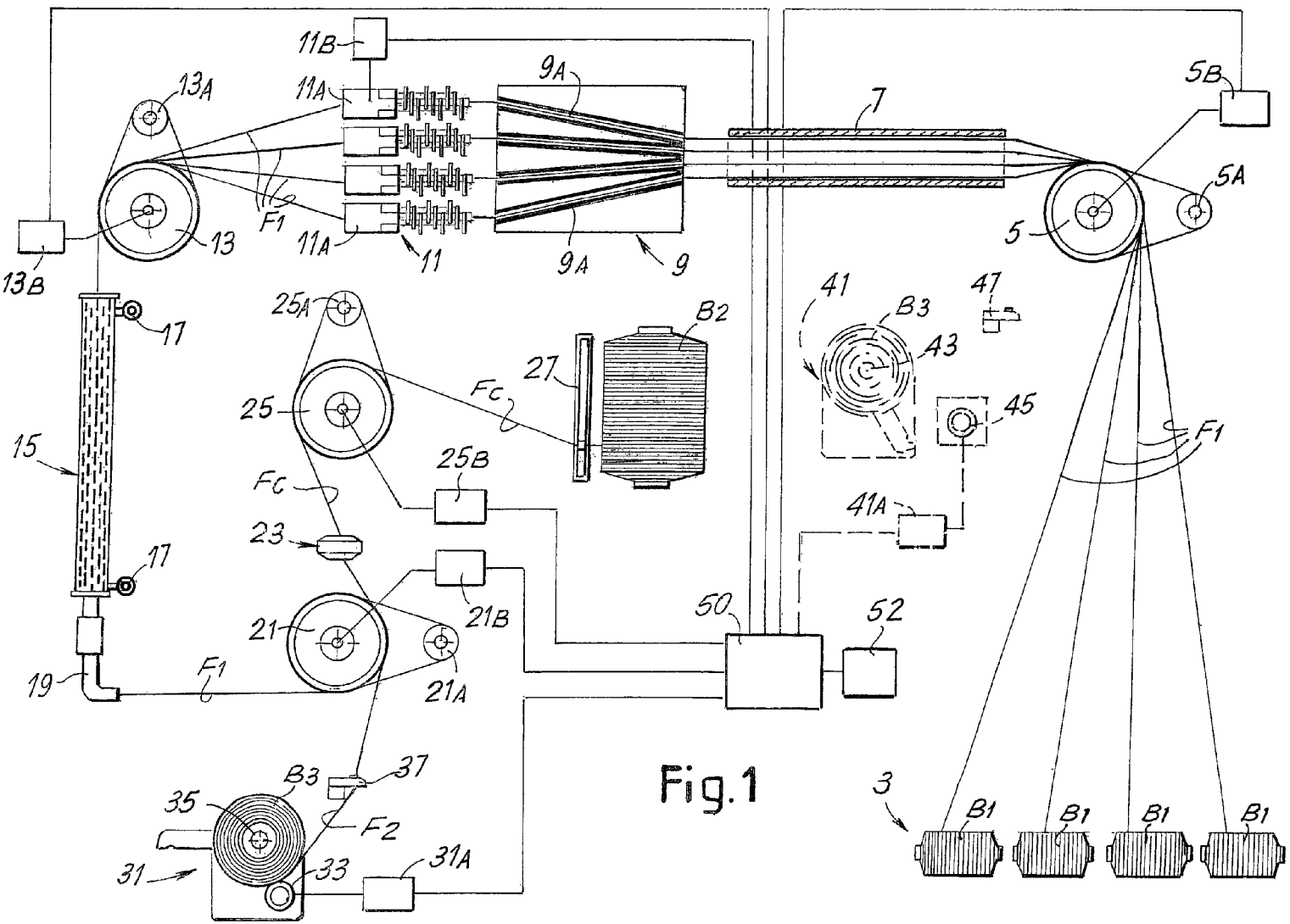
FIG. 1 shows a diagram of the machine according to the invention in a first configuration.

With initial reference to FIG. 1, the machine comprises a creel 3 on which bobbins B1 of a pre-oriented yarn (POY), such as Nylon®, polyester, polypropylene or the like, can be positioned. In an advantageous embodiment, the creel has four positions, i.e. it allows simultaneous unwinding of up to four bobbins B1.

The yarn that forms the bobbins B1 is typically a multifilament yarn with continuous filaments, obtained with extrusion processes of known type. Single yarns F1 are unwound from the bobbins B1 and guided around a stretching roller 5. In practice, in this configuration each yarn F1 is guided around the roller 5 and around an auxiliary roller 5A forming a plurality of turns. The roller 5 is motorized by its own motor schematically indicated with 5B, at a controlled speed to obtain, in combination with the members downstream along the feed path of the yarns F1 in the manner to be described below, stretching of the filaments forming the yarns F1.

Downstream of the stretching roller 5 a path of the yarn extends, comprising in the first place a first oven 7 for heat treatment of each single yarn F1 coming from each bobbin B1 disposed on the creel 3. The oven 7 is designed so that it has a number of feed tracks of the yarn preferably equal to the maximum number of bobbins B1 that can be arranged on the creel 3, so that the various yarns F1 are fed along their own heating path inside the oven 7.

At the outlet of the oven 7 a cooling area 9 is provided. In some embodiments, in the cooling area 9 there are provided single cooling plates 9A, designed in a known manner (see for example EP-A-0,571,975). Preferably, the number of the cooling plates is also in this case equal to the maximum number of bobbins B1 that can be unwound in the creel 3.

Again along the path of the yarns F1, downstream of the cooling area 9, there is located a twisting unit 11, or more precisely a false twisting unit 11, i.e. suitable to impart a false twist on each of the yarns F1 individually (or on several adjacent yarns F1). In some embodiments, the false twisting unit 11 comprises a plurality of false twisting devices or spindles 11A. In one embodiment the number of false twisting spindles 11A is equal to the maximum number of bobbins B1 that can be disposed on the creel 3, four in the example illustrated.

The false twisting unit 11 can be equipped with a single motor that operates the four spindles 11A. Alternatively, each spindle 11A can be equipped with its own motor 11B.

Each false twisting device or unit 11A can be designed in a known manner (see for example WO-A-03/014445).

Again along the path of the yarn, or of the individual yarns F1, downstream of the false twisting unit 11, a guide roller 13 for the yarns F1 is arranged, with which an auxiliary roller 13A is associated. Hereunder the roller 13 will be indicated as master roller. The rotation speed thereof is imparted by a separate motor 13B and is coordinated with the rotation speed of the stretching roller 5 so that in the section of the path of the yarn between the rollers 5 and 13 each yarn F1 is subjected to a stretching effect with a stretch percentage that can be regulated and modified by acting on the rotation speed of the rollers 5 and 13. Simultaneously, in the same section of path the yarns F1 are subjected to false twisting, which can also be set by acting on the motor or motors 11B. Typically, the peripheral speeds of the rollers 13 and 5 can differ by a percentage of approximately 1 to 2%.

Along the section of path of the yarn described above, between the creel 3 and the master roller 13, each yarn F1 is thus subjected to a texturing process which implies heating in the oven 7, cooling in the cooling area 9, false twisting in the false twisting unit 11 and stretching caused by the difference in speed of the rollers 13 and 5.

Downstream of the master roller 13 there is arranged, again along the path of the yarns F1, a second oven indicated with 15, to perform a second heat treatment on the textured yarn or yarns F1. This second heat treatment causes relaxation and shrinking of each yarn F1 fed along the feed path.

Guides, for example designed in the form of ceramic guides and indicated with 17, are associated with the oven 15, and define an alternative path for the yarn F1, outside the oven 15. In this manner, each yarn F1, or some of these yarns, can pass outside the oven 15 and therefore not undergo heat treatment after the stretching caused by the master roller 13. When several yarns F1 coming from the bobbins B1 of POY are fed along the path, usually the yarns all pass parallel to one another either through the oven 15 or outside the oven 15.

At the outlet of the oven 15 there is provided a guide 19, which diverts the yarns F1 delivered from the oven 15 toward a godet roller 21, hereinafter also indicated as stabilizing roller. The godet roller 21 is operated by its own separate motor 21B, so that its speed can be set individually and separately with respect to the rotation speed of the other rollers and of the false twisting spindles. Around the roller 21 and around an auxiliary roller 21A the yarns F1 form a series of turns and are then diverted downstream of the stabilizing roller 11 toward an interlacing device 23. In some embodiments the interlacing device 23 is an air interlacing device of known type and not described in greater detail here.

Downstream of the interlacing device 23 there is provided a further godet roller 25, hereinafter indicated as overfeed roller, with which an auxiliary roller 25A is associated. Around the roller 25 and the roller 25A the yarn indicated with FC delivered from the interlacing device 23 forms a series of turns and is then diverted along the final section of the path to a traversing device 27 which winds the treated yarn on a bobbin or finished pack. The overfeed roller 25 is preferably operated by a separate motor 25B, so that its speed can be set separately with respect to the other rollers provided in the feed path of the yarns and with respect to the speed of the false twisting spindles 11A.

In the configuration shown in FIG. 1, the machine also comprises a first supporting and unwinding member 31 for a bobbin of elastomer B3. The supporting and unwinding member 31 comprises a roller 33 that transmits the unwinding movement to the bobbin B3 supported idle on a shaft 35 stressed against the roller 33. The member 31 also comprises a sensor 37 to detect the presence of the yarn. The reference 31A schematically indicates a separate motor that controls the supporting and unwinding member 31 and the speed of which can be adjusted separately from the speed of the other motorized members of the machine.

The reference F2 indicates the elastomer that is unwound from the bobbin B3 and, passing through the sensor 37, is guided around the stabilizing roller 21. Downstream of this stabilizing roller 21 the yarns F1 and F2 follow the same path and are joined in the interlacing device 23, where the filaments of the yarns F1 cover the elastomer F2. In substance, therefore, at the outlet of the interlacing device 23 a composite yarn FC is obtained, which is then wound around the overfeed roller 25 and taken up on the bobbin B2.

Ultimately, in the configuration of FIG. 1, the machine can perform individual texturing of the single yarns F1 coming from the creel 3, relaxation heat treatment in the oven 15 and subsequently coupling with the elastomer yarn F2 to cover the latter in the interlacing device 23.

In some embodiments the feed speed of the overfeed roller 25 is lower than the feed speed of the stabilizing roller 21. This latter, in turn, in some embodiments presents a greater feed speed with respect to that imparted by the feed roller 33 to the elastomer yarn F2. This yarn is thus stretched between the supporting and unwinding member 31 and the stabilizing godet roller 21.

The diagram of FIG. 1 indicatively also represents a second supporting and unwinding member 41 comprising a shaft 43 for supporting a bobbin of elastomer yarn, a feed roller 45, a sensor 47 and a motor indicated schematically with 41A. The members 41A, 43, 45 and 47 are substantially equivalent to the members 31A, 33, 35 and 37 described previously and forming the supporting and unwinding member 31. This second supporting and unwinding member 41 can be used alternatively to the supporting and unwinding member 31 when the machine is used in the configuration represented in FIG. 2 and described below in greater detail.

Finally, the reference 50 indicates a control unit, connected to user interface devices 52, for example comprising a monitor or display and a keyboard, which controls and manages the speeds of the various motors of the machine according to the user's settings, for example on the basis of values preset in memorized management programs selectable by the user.

Figure 2:
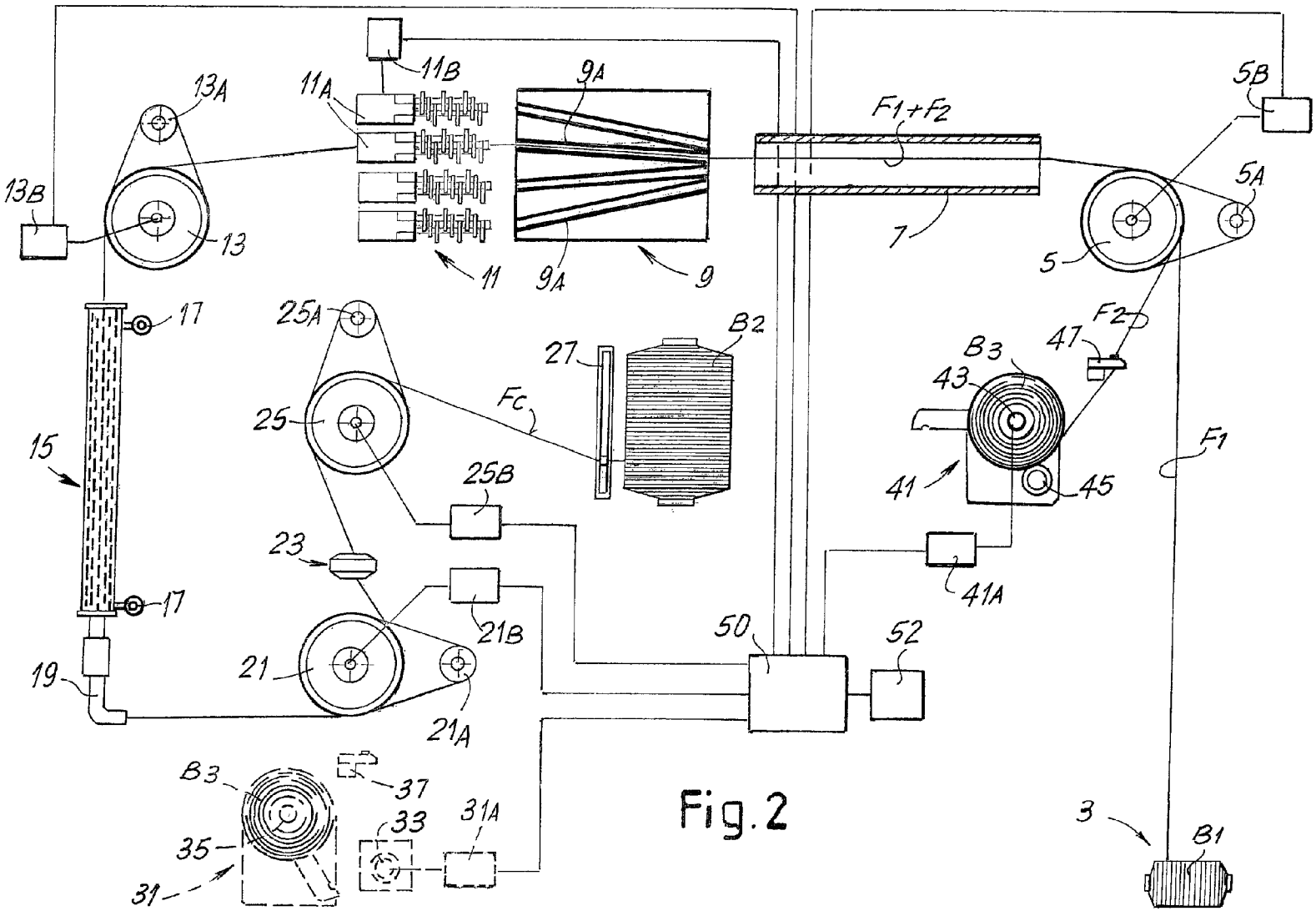
FIG. 2 shows a diagram of the machine according to the invention in a second configuration.

In FIG. 2 the same or equivalent elements to those of FIG. 1 are indicated with the same reference numbers.

In the configuration of FIG. 2, a single bobbin B1 of POY F1 is placed on the creel 3. Said yarn passes through the oven 7 and the cooling area 9 and is subjected to false twisting by one of the spindles 11A of the false twisting unit 11. The path of the yarn F1 then continues around the stretching roller 13, inside the oven 15, around the stabilizing roller 21A, through the interlacing device 23, around the overfeed roller 25 and is then taken up by the traversing device 27 on the bobbin B2.

Contrary to the configuration of FIG. 1, in the configuration of FIG. 2 the elastomer comes from a bobbin B3 supported and fed by the supporting and unwinding member 41, while the supporting and unwinding member 31 is in the inactive position. The elastomer yarn, again indicated with F2, is then fed from the supporting and unwinding member 41 to the stretching roller 2 and thereafter follows the same path as the yarn F1 to subsequently be covered, by the air interlacing device 23, with the filaments of the yarn F1. Consequently, the yarn F2 is subjected, together with the yarn F1, to the heating, cooling, false twisting, stretching, reheating and relaxation operations described previously for the yarns F1. The speed ratios between the various rollers 5, 13, 21 and 25 can be the same as those described with reference to the configuration of FIG. 1 and can be adjusted as required due to the presence of separate motors for each of the motorized members disposed along the path of the yarns. The unwinding roller 45 of the supporting and unwinding member 41 preferably presents a speed so that the yarn F2 can be subjected to a pre-stretching step in the section between the stretching roller 5 and the unwinding roller 45, the latter thus having lower peripheral speed (for example 1.5 to 3.5% lower) with respect to the peripheral speed of the roller 5.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A texturing and interlacing machine for processing synthetic yarns, the machine comprising:

at least one supporting and unwinding member for at least one bobbin of untreated yarn to be textured;

at least one supporting and unwinding member for a bobbin of elastomer;

a feed path, for at least one yarn to be textured;

a second path for at least a second yarn to be textured, at least a portion of said second feed path being adjacent to said at least a portion of said feed path, said at least portion of said feed path being separate from said at least said portion of said second feed path;

along said feed path for at least one yarn to be textured, in sequence along a direction of feed of said at least one yarn to be textured: a stretching roller, a first oven, a cooling area, a yarn twisting unit, a master roller, a second oven, a stabilizing roller, an interlacing device and an overfeed roller.

2. A machine as claimed in claim 1, wherein said stretching roller, said master roller, said stabilizing roller and said overfeed roller are controlled by motors configured to adjust the speeds of said rollers separately from one another.

3. A machine as claimed in claim 1, wherein said stretching roller, said master roller, said stabilizing roller and said overfeed roller are controlled by separate motors.

4. A machine as claimed in claim 1, wherein said twisting unit comprises at least one separate motor.

5. A machine as claimed in claim 1, wherein said supporting and unwinding member for the untreated yarn to be textured is designed to simultaneously support and unwind four bobbins of untreated yarn to be textured.

6. A machine as claimed in claim 1, wherein said twisting unit is a false twisting unit.

7. A machine as claimed in claim 1, wherein said interlacing device comprises an interlacing air jet.

8. A machine as claimed in claim 1, wherein an alternative path for the yarn is arranged at a side of the second oven, said alternative path passing outside the oven.

9. A machine as claimed in claim 1, wherein said first oven comprises a plurality of paths for a plurality of adjacent yarns.

10. A machine as claimed in claim 1, wherein said cooling area comprises a plurality of adjacent cooling plates for a corresponding plurality of yarns.

11. A machine as claimed in claim 1, wherein said at least one supporting and unwinding member for a bobbin of elastomer is arranged so as to feed said elastomer through said first oven.

12. A machine as claimed in claim 11, wherein said supporting and unwinding member for a bobbin of elastomer is arranged so as to feed said elastomer to said stretching roller.

13. A machine as claimed in claim 1, wherein said at least one supporting and unwinding member for a bobbin of elastomer is arranged so as to feed said elastomer toward said feed path, downstream of the second oven.

14. A machine as claimed in claim 13, wherein said supporting and unwinding member for a bobbin of elastomer is arranged to feed said elastomer to said stabilizing roller.

15. A machine as claimed in claim 1, further comprising a second supporting and unwinding member for a bobbin of elastomer, arranged so as to feed said elastomer toward said feed path, downstream of the second oven, wherein said at least one supporting and unwinding member is arranged so as to feed said elastomer through said first oven.

16. A machine as claimed in claim 1, wherein said stretching roller and said master roller are controlled at different rotation speeds to each other such that a stretch is imparted on the yarn or yarns fed around said stretching roller and said master roller.

17. A machine as claimed in claim 1, wherein said stabilizing roller rotates at a lower peripheral speed with respect to a peripheral speed of the master roller.

18. A machine as claimed in claim 14, wherein said supporting and unwinding member for a bobbin of elastomer and said stabilizing roller are controlled at speeds such as to impart a stretch on the elastomer fed by said supporting and unwinding member.

19. A machine as claimed in claim 12, wherein said supporting and unwinding member for a bobbin of elastomer and said stretching roller are controlled at speeds such as to impart a stretch on the elastomer between the bobbin and the stretching roller.

20. A machine as claimed in claim 2, wherein said stretching roller, said master roller, said stabilizing roller and said overfeed roller are controlled by separate motors.

21. A machine as claimed in claim 2, wherein said twisting unit comprises at least one separate motor.

22. A machine as claimed in claim 3, wherein said twisting unit comprises at least one separate motor.

23. A machine as claimed in claim 1, wherein said supporting and unwinding member for the untreated yarn to be textured is designed to simultaneously support and unwind four bobbins of untreated yarn to be textured.

* * * * *